US007021104B2

(12) United States Patent
Drigani et al.

(10) Patent No.: US 7,021,104 B2
(45) Date of Patent: Apr. 4, 2006

(54) DEVICE TO ABSORB THE AXIAL LOADS GENERATED ON THE ROLLS IN A ROLLING STAND

(75) Inventors: Fausto Drigani, Zugliano-Pozzuolo del Friuli (IT); Stanislaw Pawlowski, Mulheim an der Ruhr (DE); Enrico Ventulini, Nespoledo (IT)

(73) Assignee: Danieli & C. Officine Meccaniche SpA, Buttrio (IT)

( * ) Notice: Subject to any disclaimer, the term of this patent is extended or adjusted under 35 U.S.C. 154(b) by 306 days.

(21) Appl. No.: 10/381,099

(22) PCT Filed: Sep. 24, 2001

(86) PCT No.: PCT/IB01/01739

§ 371 (c)(1),
(2), (4) Date: Mar. 21, 2003

(87) PCT Pub. No.: WO02/24357

PCT Pub. Date: Mar. 28, 2002

(65) Prior Publication Data

US 2004/0003643 A1 Jan. 8, 2004

(30) Foreign Application Priority Data

Sep. 25, 2000 (IT) ..... UD00A0180

(51) Int. Cl.
*B21B 31/02* (2006.01)

(52) U.S. Cl. ..... 72/241.2; 72/237; 72/247

(58) Field of Classification Search ..... 72/237, 72/241.2, 247, 248

See application file for complete search history.

(56) References Cited

U.S. PATENT DOCUMENTS 4,154,080 A * 5/1979 Suzuki et al. ..... 72/237

FOREIGN PATENT DOCUMENTS

| | | |
|---|---|---|
| DE | 19934027 | 3/2000 |
| EP | 0750952 | 1/1997 |

(Continued)

OTHER PUBLICATIONS

Patent Abstracts of Japan, vol. 007, no. 10 (M-217)(May 25, 1983).

(Continued)

*Primary Examiner*—Lowell A. Larson
(74) *Attorney, Agent, or Firm*—Stevens, Davis, Miller & Mosher, LLP

(57) ABSTRACT

Device to absorb the axial loads generated on the rolls in a rolling stand (11) having a pair of working rolls (12*a*, 12*b*), a corresponding pair of back-up rolls (15*a*, 15*b*) and at least an intermediate roll (14) located between a working roll (12*a*) and a corresponding back-up roll (15*a*), in said device holding means (16, 40, 41) are provided to support the axial loads on the back-up rolls (15*a*, 15*b*) and/or the working rolls (12*a*, 12*b*) caused by the crossing of said at least one intermediate roll (14), so that the axial loads are discharged onto elements with very low rolling friction, totally or almost totally annulling the hysteresis relating to the vertical movements of the back-up rolls (15*a*, 15*b*) and working rolls (12*a*, 12*b*) and the relative chocks (26).

14 Claims, 4 Drawing Sheets

U.S. PATENT DOCUMENTS

| | | | | |
|---|---|---|---|---|
| 5,596,898 | A * | 1/1997 | Drigani et al. | 72/236 |
| 5,782,127 | A | 7/1998 | Donini et al. | |
| 6,151,943 | A | 11/2000 | Nihei et al. | |
| 6,286,354 | B1 | 9/2001 | Kajiwara et al. | |

FOREIGN PATENT DOCUMENTS

| | | |
|---|---|---|
| JP | 57195510 | 12/1982 |
| JP | 58038601 | 3/1983 |
| JP | 05317918 | 12/1993 |
| JP | 06226304 | 8/1994 |

OTHER PUBLICATIONS

Patent Abstracts of Japan, vol. 018, no. 594 (M-1703)(Nov. 14, 1994).
Patent Abstracts of Japan, vol. 018, no. 127 (M-1569)(Mar. 2, 1994).
Patent Abstracts of Japan, vol. 007, no. 047 (M-196)(Feb. 24, 1983).

* cited by examiner

DEVICE TO ABSORB THE AXIAL LOADS GENERATED ON THE ROLLS IN A ROLLING STAND

FIELD OF THE INVENTION

The invention refers to a device to absorb the axial loads generated on the rolls in a rolling stand, and in particular on the working rolls and the back-up rolls in a six-high stand.

BACKGROUND OF THE INVENTION

It is well-known that two counter-rotating rolls thrust against each with a determined force S and subjected to reciprocal crossing by a determined angle $\alpha$ (FIG. 1), even limited to a few tenths of a degree, with respect to the vertical plane passing through the median rolling axis, are also subject to axial thrusts.

In the zone of contact between the working rolls in a rolling stand, because of the sliding speeds $V_S=V'-V$ (vectorial difference of the peripheral speeds of the rolls), where V is the peripheral speed of the upper roll and V' is the peripheral speed of the lower roll, and because of the contact friction due to the force S, axial forces T are produced on the upper roll and T' on the lower roll, which can even be of strong intensity, if the force S is high.

Therefore, a rolling stand equipped with a system to cross the rolls such as to generate an angle $\alpha$ between two rolls in contact generates a thrust T, which changes sign when the rotation of the rolls is reversed, and which is discharged onto the respective thrust bearings A and B.

In the case of a six-high rolling stand, the two intermediate rolls (IR), pressed with the force of separation S by the corresponding back-up rolls (BUR) and working rolls (WR) on opposite generatrixes, if they are inclined, that is crossed, by the same angle anti-symmetrically, induce axial forces of the opposite sign on the back-up rolls and the working rolls.

The thrusts which can occur are transmitted by means of the thrust bearings to the respective chocks, which discharge them on the bilateral axial holding elements (called chock gates) which discharge the forces onto the housings of the stand.

It should be noted that the intermediate rolls are, in theory, exempt from axial thrust, since each is loaded, on the two opposite generatrixes, with equal axial forces of the opposite sign, if the friction coefficients on the two contacts are equal.

Consequently, it is necessary to adopt low-friction holding elements (chock gates), both for the working rolls and for the back-up rolls, in order to contain the vertical friction forces which generate hysteresis which impedes the small vertical movements of the roll pack during rolling.

The axial forces are discharged onto the chock, which transmits the load to the chock gates which clamp the chock axially.

To regulate the thickness of the rolled product, it must be easy to position the rolling rolls vertically.

The reaction of the chock gates, multiplied by the coefficient of friction between the chock and the chock gate, generates a vertical force which opposes the movement of vertical positioning of the rolls. Thus a hysteresis is created which has a harmful effect on the correct control of the thickness of the rolled product.

SUMMARY OF THE INVENTION

The device to absorb axial loads generated on the rolls in a rolling stand according to the invention is set forth and characterized in the main claim, while the dependent claims describe other innovative features of the invention.

One purpose of the invention is to achieve a device which will allow both the working rolls and the back-up rolls to be contained axially so that the vertical force generated by friction can be restrained to very low levels, to limit as much as possible the hysteresis which impedes the small vertical movements of the roll pack during rolling, which are needed to adequately control the thickness.

In accordance with this purpose, the device according to the invention comprises holding means to support the axial loads on the back-up rolls and the working rolls caused by the crossing of the intermediate rolls, so that the axial loads are discharged onto very low friction means, of the rolling type, totally or almost totally annulling the hysteresis relating to the vertical movements of the rolls and of the relative chocks.

To be more exact, the holding means comprise at least a rolling element which, in the case of back-up rolls, consists advantageously of a rolling bearing whereas, in the case of the working rolls, consists of a barrel-shaped element.

BRIEF DESCRIPTION OF THE DRAWINGS

These and other characteristics of the invention will become clear from the following description of a preferred form of embodiment, given as a non-restrictive example with reference to the attached drawings wherein.

DETAILED DESCRIPTION OF A PREFERENTIAL EMBODIMENT

Figure 1:
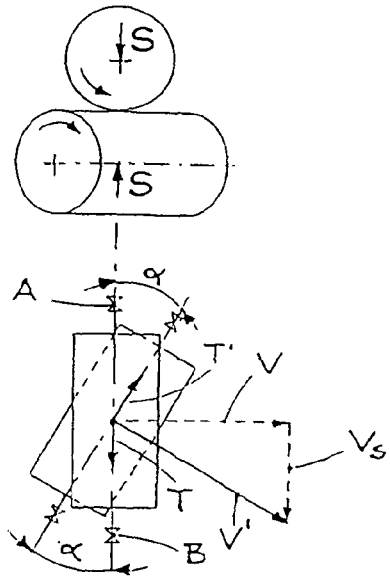
FIG. 1 is a diagram illustrating the forces which develop between two counter-rotating rolls.
Figure 2:
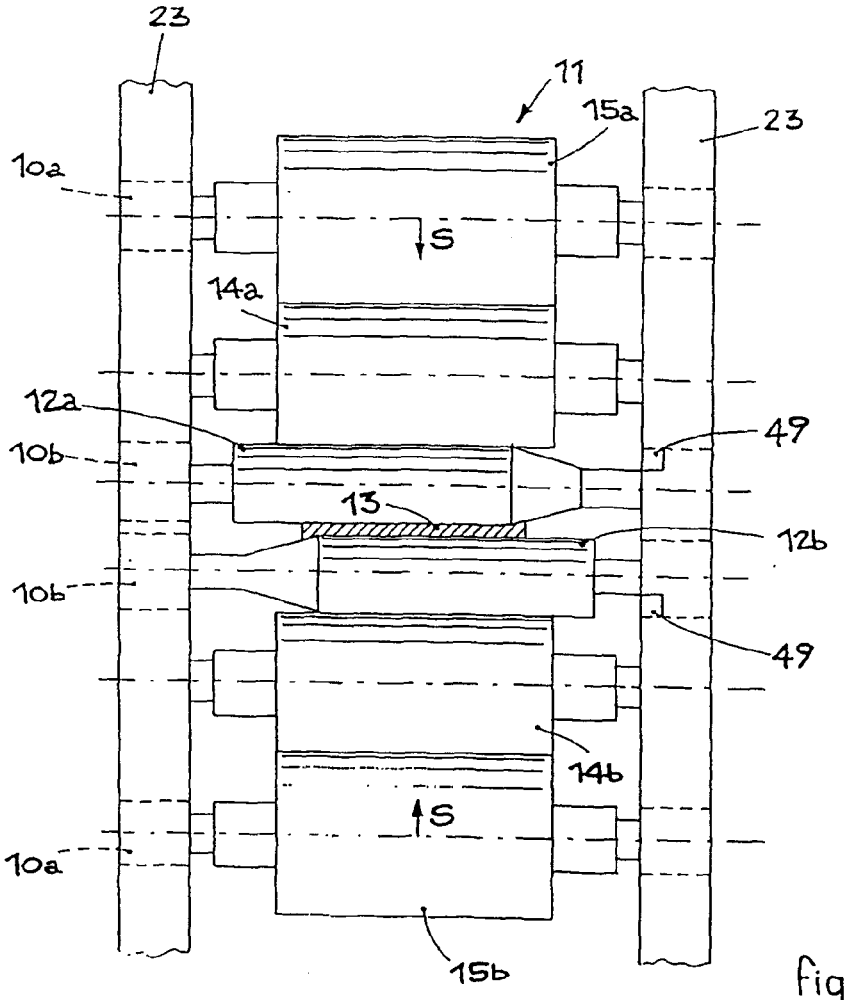
FIG. 2 is a schematic view of a six-high rolling stand on which a device according to the invention is assembled.

With reference to FIG. 2, a device 10*a*–10*b* according to the invention is shown assembled in a six-high rolling stand 11, which comprises a pair of working rolls 12*a*, 12*b*, between which the plane product 13 to be rolled, consisting for example of steel strip, is able to pass.

Associated with the two working rolls 12*a*, 12*b* there are two corresponding intermediate rolls 14*a*, 14*b*, and two back-up rolls 15*a*, 15*b* which are able to contrast the thrusts due to the rolling of the product 13 and to prevent an excessive bending of the working rolls 12*a*, 12*b* and that of the intermediate rolls 14*a*, 14*b*.

The device according to the invention comprises two assemblies 10*a* associated with the back-up rolls 15*a* and 15*b* and two assemblies 10*b* associated with the working rolls 12*a* and 12*b*, to support them adequately with respect to the housings 23 of the stand 11.

Figure 3:
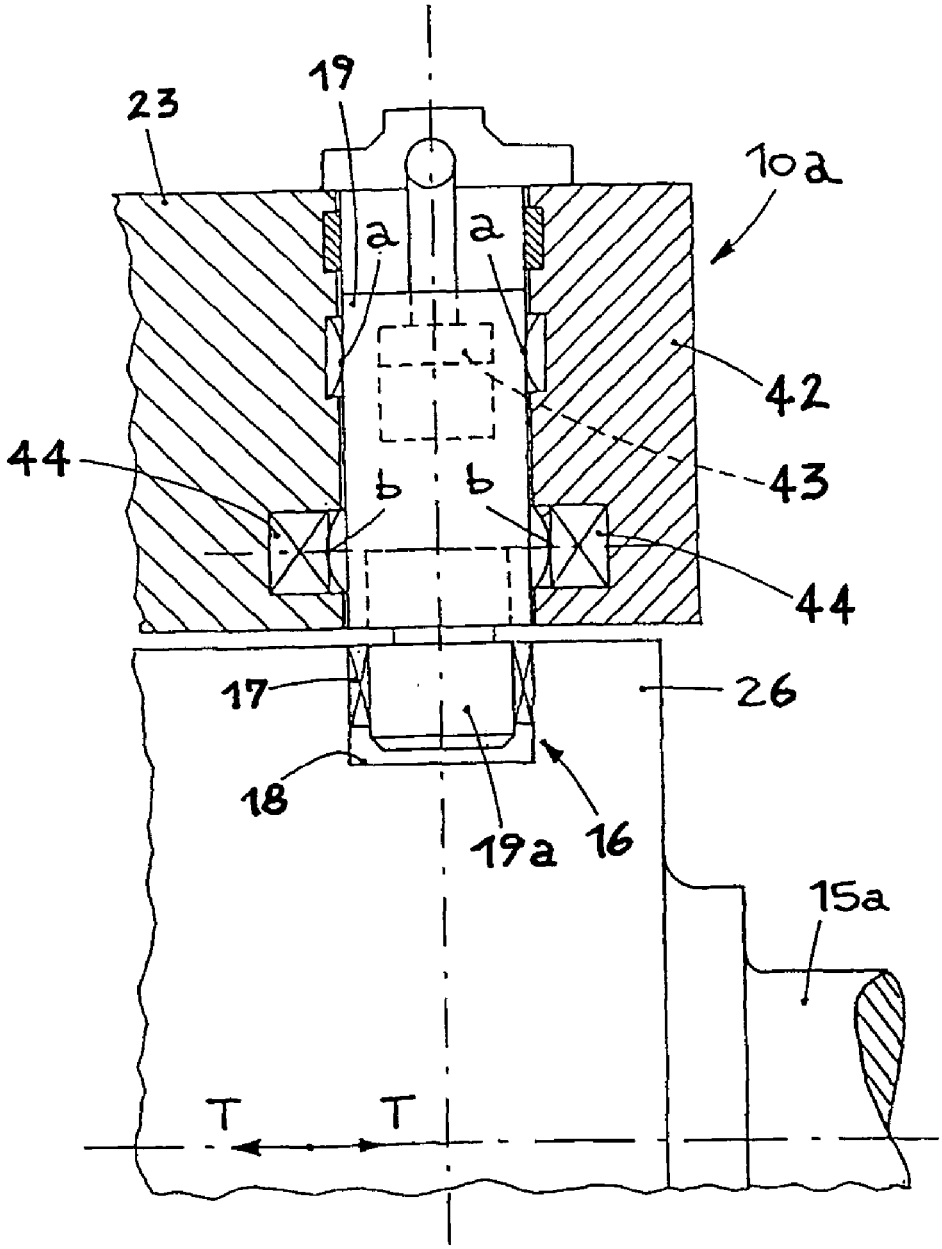
FIG. 3 is a partly sectioned view of a device according to the invention associated with a back-up roll of the stand shown in FIG. 1.

Each device 10*a* (FIG. 3) associated with the back-up rolls 15*a* and 15*b* comprises a holding element 16 provided with a rolling bearing 17, which is inserted in a mating groove 18, made in a chock 26, associated with the roll to be supported, which in the example shown here is the upper back-up roll 15*a*.

The bearing 17 is mounted cantilevered on the end 19*a* of a tube 19 with a polygonal cross section, which is guided prismatically partly on the housing 23 and partly on a fixed frame 42, which is attached to the housing 23.

A double effect hydraulic cylinder 43 is able to selectively command the insertion and removal of the bearing 17 into/from the groove 18 of the chock 26, to arrange the back-up roll 15*a* in a working position and respectively an inactive position or roll change position.

The bearing 17 allows the chock 26 to move freely in a vertical direction, practically without friction or with friction reduced to a minimum.

Every device 10*a* also comprises a load cell 44 able to measure the constraint reactions at point b of the tube 19, which rests at points a and b, in order to determine the value of the force T.

When the rolling stand 11 is of the reversible type, there are two load cells 44 provided, arranged on opposite sides of the tube 19.

Figure 4:
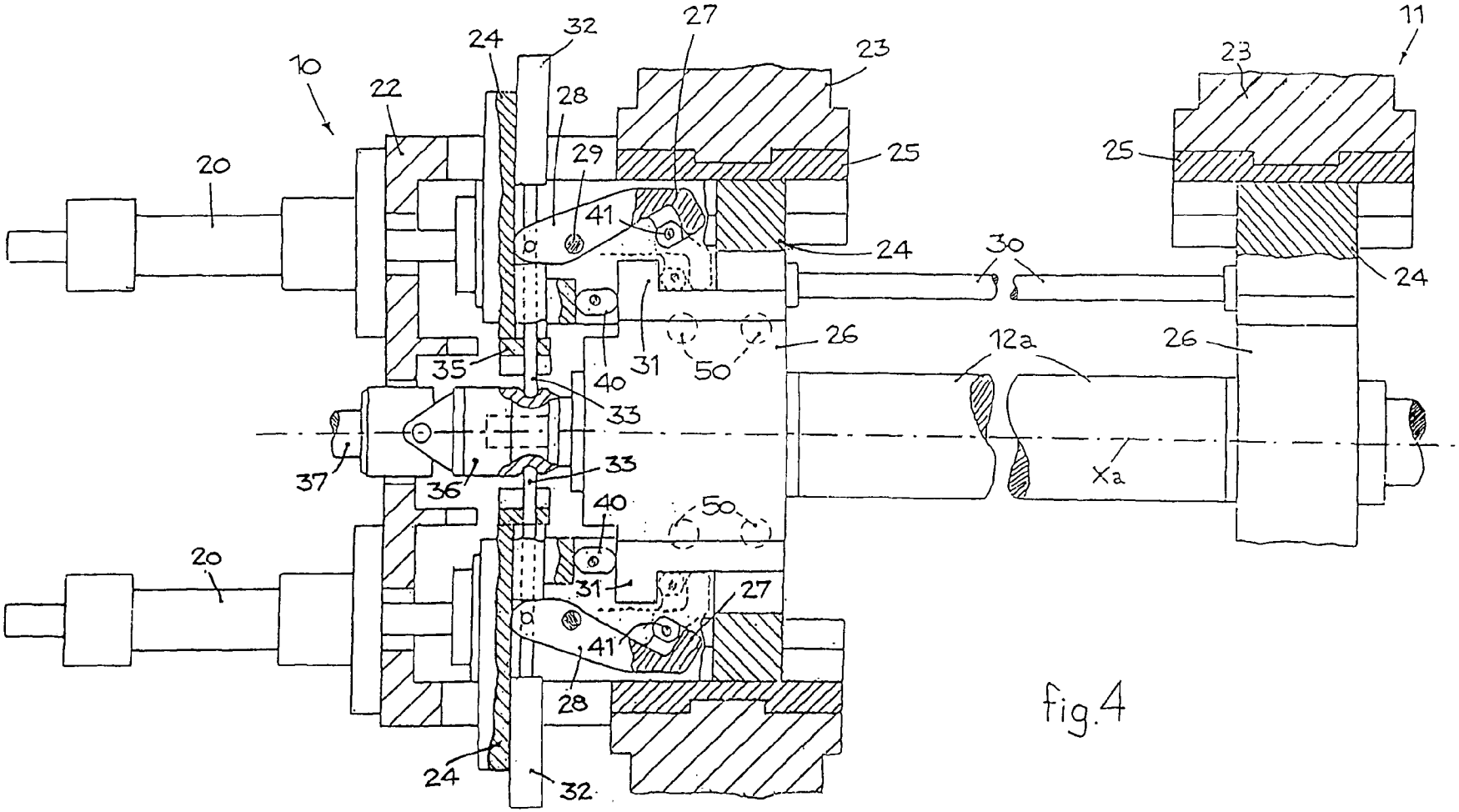
FIG. 4 is a part and sectioned front view of the rolling stand in FIG. 3.

Each device 10*b* associated with the working rolls 12*a* and 12*b* comprises a pair of cylindrical actuators 20 (FIG. 4) which can be activated simultaneously. It must be pointed out that, to simplify the drawing, in FIG. 4 only the device 10*b* associated with the upper working roll 12*a* is shown, while the other device 10*b*, that is, the one associated with the lower working roll 12*b*, is the same as the one shown.

The actuators 20 are arranged on the same motor side (on the left in FIG. 4) and are assembled on a supporting frame 22, attached to a housing 23 of the rolling stand 11.

The actuators 20 are able to shift, simultaneously and parallel to the axis Xa of the working roll 12*a*, a pair of movable blocks 24 which are assembled each on a housing 23 of the rolling stand 11 and are connected together by a connection rod 30.

The movable blocks 24 are guided on prismatic guides 25 attached in the housings 23.

The motor side chock 26 (on the left in FIG. 4) is provided with shoulders 31, arranged transverse to the axis Xa; the corresponding movable block 24 is able to cooperate with the sides thereof, in order to shift the working roll 12*a* axially.

To be more exact, the axial shifting of the working roll 12*a* towards the operator side (on the right in FIG. 4) is performed by a direct thrust of the movable block 24 on the left-hand sides of the shoulders 31.

To transform the sliding friction into rolling friction, a first rolling element 40, substantially barrel-shaped, is assembled on the movable block 24, in correspondence with each shoulder 31; in the working position said element 40 is in contact with the corresponding left side of the shoulder 31.

Figure 5:
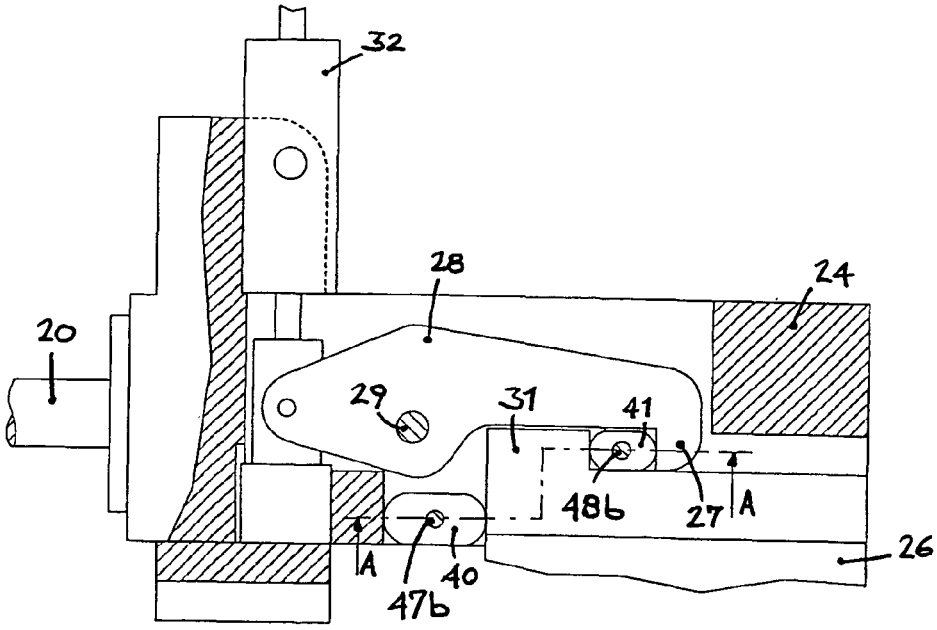
FIG. 5 is an enlarged detail of FIG. 4.

On the contrary, the axial shifting of the working roll 12*a* towards the motor side (on the left in FIG. 4) is performed by a pair of hook-type levers 28, each of which pivots on a pin 29 of the movable block 24 and oscillates between an inactive position (un-hooked from the corresponding shoulder 31) and a working position (hooked onto the shoulder 31), shown by a line of dashes in FIG. 5.

Each lever 28, in correspondence with its terminal hook 27, is provided with a second rolling element 41, also barrel-shaped, which is able to cooperate with the corresponding right-hand side of the shoulder 31 of the chock 26, when the lever 28 is in the working position.

The lever 28 is rotated by means of a pair of hydraulic cylinders 32 assembled on the movable block 24 and able to be activated simultaneously.

To be more exact, the levers 28 are closed when the hydraulic cylinders 32 are in the contracted position, while with the hydraulic cylinders 32 in the extended position the levers 28 are opened.

The hydraulic cylinders 32 also act on two holding elements 33 (FIGS. 10 and 11) able to slide axially on the movable block 24 and guided on horizontal platelets 35.

The holding elements 33, in the extended position of the hydraulic cylinders 32, are able to support a spindle-support element (called "coupling ring") 36, arranged on the command side of the relative spindle 37 which connects the working roll 12*a* to the motor assembly, which is not shown in the drawings.

Therefore, the hydraulic cylinders 32, in the extended position, are able both to open the hook-type lever 28 and also, at the same time, to support the element 36 (change position of the working roll 12*a*), while in the contracted position, they are able to close the hook-type lever 28 on the chock 26 and to simultaneously release the element 36 (working position).

According to a variant, not shown in the drawings, the holding elements 33 consist of a saddle, for example formed by the platelets 35, which is able to move with respect to the movable block 24 to selectively arrange itself below the element 36, on the command of the hydraulic cylinders 32.

The contemporary movements, obtained simply by driving the hydraulic cylinders 32, of the closing/opening of the hook-type levers 28 and the opening/closing of the spindle-support elements 36, not only simplify the mechanical solution but also shorten the sequence of the roll change, and make it more reliable.

The function of the rolling elements 40 and 41 is to transform the sliding friction into rolling friction when the chock 26 is displaced in a vertical direction.

Figure 6:
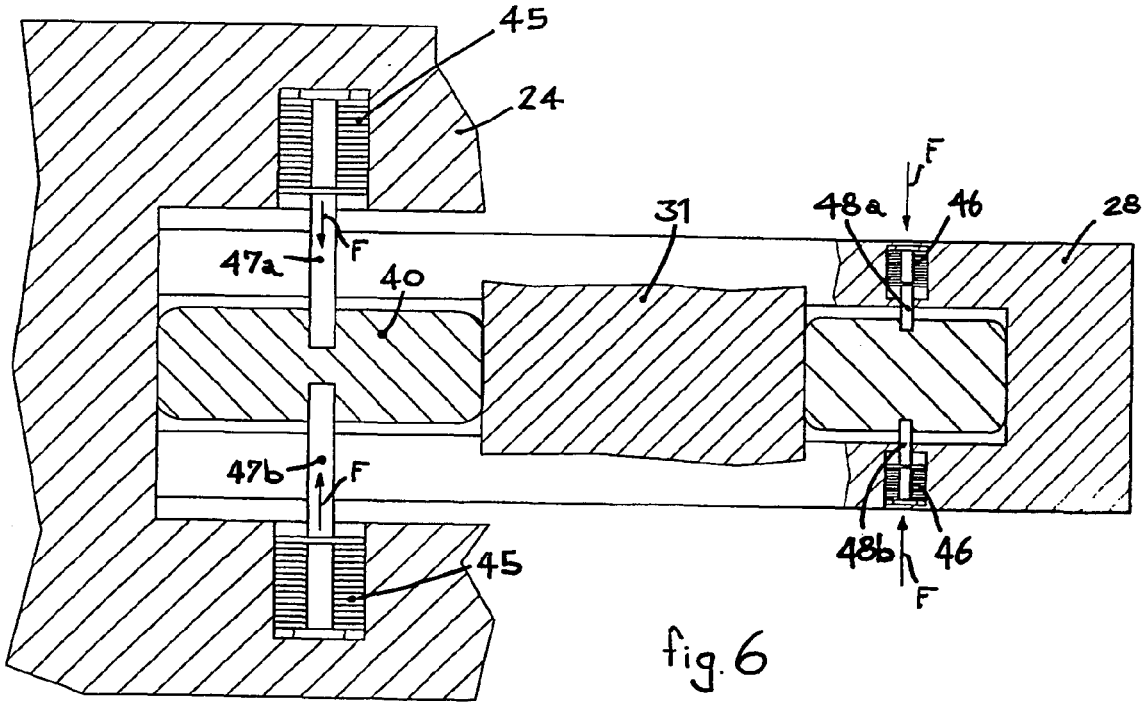
FIG. 6 is a section from A to A of FIG. 5.

The rolling element 40 (FIGS. 5 and 6) is mounted rotatable on two coaxial pins 47*a* and 47*b* of the movable block 24, while the rolling element 41 is mounted rotatable on two coaxial pins 48*a* and 48*b* supported by the lever 28.

The rolling elements 40 and 41 are kept in a horizontal position by two packs of cup-type springs 45 and respectively 46, so that they can transmit the forces (actions and reactions) between the movable block 24 and the chock 26 in both directions. Therefore, when one rolling element is compressed (for example the element 40), the other is released (for example the element 41).

Each rolling element 40 and 41 is thus able to pivot horizontally to follow the small movements of the chock 26 during rolling.

If the force transmitted by each rolling element 40, 41, multiplied by the coefficient of friction, is less than the return forces of the corresponding cup-type springs 45 and 46, the rolling element 40, 41 is repositioned horizontally by said cup-type springs. This certainly happens at the end of rolling of a strip 13, when the axial forces between the working rolls 12*a*, 12*b*—intermediate rolls 14*a*, 14*b*—back-up rolls 15*a*, 15*b*, generated by possible relative axial movements between the working/intermediate/back-up rolls and between the working rolls 12*a*, 12*b* and the strip 13 descend to practically zero values, since the vertical rolling force stops.

In conditions when the axial force is greater than a value such that $\mu F$ is greater than the force F of the cup-type springs 45, 46, one of the two rolling elements 40 or 41, the compressed one, will rotate, transforming the sliding friction into rolling friction.

In this way, the vertical hysteresis on the chocks 26 is reduced to a value which practically does not depend on the axial load of the shifting on the rolling rolls.

The axial thrust on the working rolls 12*a* and 12*b* is monitored by means of transducers 49 (FIG. 2).

In the device 10 as described heretofore, the movable blocks 24 (FIG. 4) have the same shifting movements as the chocks 26 of the corresponding working roll 12*a*, 12*b*; therefore the hydraulic jacks 50, which are assembled on the movable blocks 24 and are included to bend the rolls, always act on the same point of the chock 26.

It is obvious that modifications or additions may be made to the device 10 as described heretofore, without departing from the spirit and scope of the invention.

It is also obvious that, although the invention has been described with reference to a specific example, a skilled person shall certainly be able to achieve many other equivalent variants, all of which shall come within the field and scope of this invention.

What is claimed is:

1. Device to absorb the axial loads generated on the rolls of a rolling stand comprising a pair of working rolls, a corresponding pair of back-up rolls, at least an intermediate roll located between one of said working rolls and a corresponding back-up roll, two pair of chocks for rotatably supporting said pair of back-up rolls, and a housing for supporting said two pair of chocks, holding means for supporting the axial loads on said back-up rolls caused by the crossing of said at least one intermediate roll, so that said axial loads are discharged onto elements with very low friction, of the rolling type, for annulling the hysteresis relating to the vertical movements of said back-up rolls and of said pair of chocks, wherein said holding means comprises at least a rolling bearing associated with each one of said chocks, wherein each one of said chocks comprises a mating groove and wherein said rolling bearing is able to be selectively inserted into said mating groove.

2. Device to absorb the axial loads generated on the rolls of a rolling stand comprising a pair of working rolls, a corresponding pair of back-up rolls, at least an intermediate roll located between one of said working rolls and a corresponding back-up roll, two pair of chocks for rotatably supporting said pair of back-up rolls, and a housing for supporting said two pair of chocks, holding means for supporting the axial loads on said back-up rolls caused by the crossing of said at least one intermediate roll, so that said axial loads are discharged onto elements with very low friction, of the rolling type, for annulling the hysteresis relating to the vertical movements of said back-up rolls and of said pair of chocks, wherein said holding means comprises at least a rolling bearing associated with each one of said chocks, wherein said rolling bearing is cantilevered mounted at the end of a support element with a polygonal cross section, which is guided prismatically partly on said housing and partly on a fixed frame attached to said housing, wherein at least a first load cell is associated with said support element to determine the value of said axial loads, wherein said rolling bearing is cantilevered mounted at the end of a support element with a polygonal cross section, which is guided prismatically partly on said housing and partly on a fixed frame attached to said housing.

3. Device as in claim 1, wherein a hydraulic cylinder is able to selectively command the insertion and removal of said rolling bearing into or from said mating groove, to arrange the corresponding back-up roll in a working position and respectively an inactive or roll change position.

4. Device as in claim 2, wherein at least a first load cell is associated with said support element to determine the value of said axial loads.

5. Device as in claim 4, wherein said rolling stand is of the reversible type and wherein a second load cell is provided, arranged opposite to said first load cell with respect to said support element.

6. Device as in claim 2, wherein a hydraulic cylinder is able to selectively command the insertion and removal of said rolling bearing into or from said mating groove, to arrange the corresponding back-up roll in a working position and respectively an inactive or roll change position.

7. Device to absorb the axial loads generated on the rolls of a rolling stand comprising a pair of working rolls, a corresponding pair of back-up rolls, at least an intermediate roll located between one of said working rolls and a corresponding back-up roll, two pair of chocks for rotatably supporting said pair of working rolls, and a housing for supporting said two pair of chocks, holding means for supporting the axial loads on said working rolls caused by the crossing of said at least one intermediate roll, so that said axial loads are discharged onto elements with very low friction, of the rolling type, for annulling the hysteresis relating to the vertical movements of said working rolls and of said pair of chocks, wherein said holding means comprise at least a barrel-shaped element located between each one of said chocks and a movable block associated therewith.

8. Device as in claim 7, wherein a pair of axial pins, elastically pre-loaded by elastic means, are associated with said barrel-shaped element to keep said barrel-shaped element in a horizontally pivoting position, so as to allow said barrel-shaped element to follow the movements of said chock during the rolling step, transforming the friction from sliding friction to rolling friction.

9. Device as in claim 8, wherein said elastic means comprise cup-type springs arranged coaxial to said pins.

10. Device as in claim 7, wherein transducer means are provided to monitor the axial thrusts on said working rolls.

11. Device to absorb the axial loads generated on the rolls of a rolling stand comprising a pair of working rolls, a corresponding pair of back-up rolls, at least an intermediate roll located between one of said working rolls and a corresponding back-up roll, a plurality of chocks for rotatably supporting said pair of working rolls and said pair of back-up rolls, and a housing for supporting said two pair of chocks, holding means for supporting the axial loads on said back-up rolls and on said working rolls caused by the crossing of said at least one intermediate roll, so that said axial loads are discharged onto elements with very low friction, of the rolling type, for annulling the hysteresis relating to the vertical movements of said back-up rolls, of said working rolls and of said chocks, wherein said holding means comprise a first rolling element, substantially barrel-shaped, assembled on a movable block able to slide transversely on said housing, said first rolling element, in a working position, being in contact with a shoulder of a corresponding chock, to transform any possible sliding friction into rolling friction, wherein at least a hook-type lever pivots on said movable block to shift axially a corresponding working roll in a determined direction, said hook-type lever being able to oscillate between a working position wherein it is hooked onto said shoulder and an inactive position wherein it is released from said shoulder.

12. Device as in claim 11, wherein said hook-type lever, in correspondence with a terminal hook thereof, is provided with a second rolling element, substantially barrel-shaped, which is able to cooperate with said shoulder when said hook-type lever is in the working position.

13. Device as in claim 12, wherein said first rolling element is assembled rotatable on two first coaxial pins of said movable block, and said second rolling element is assembled rotatable on two second coaxial pins supported by said hook-type lever.

14. Device as in claim 13, wherein said rolling elements are kept in the horizontal position by two packs of cup-type springs, so that they can transmit the forces (actions and reactions) between said movable block and said chock in the two directions.

* * * * *